United States Patent [19]

Barthelemy

[11] Patent Number: 4,678,986

[45] Date of Patent: Jul. 7, 1987

[54] ELECTRIC TRANSFORMER WITH SELECTIVELY ENERGIZED MODULAR CIRCUITS

[76] Inventor: Louis Barthelemy, Résidence Longchamp, 78770 Thoiry, France

[21] Appl. No.: 856,449

[22] Filed: Apr. 24, 1986

Related U.S. Application Data

[63] Continuation of Ser. No. 497,013, May 23, 1983, abandoned.

[30] Foreign Application Priority Data

May 25, 1982 [FR] France ..... 82 08998

[51] Int. Cl.[4] ..... G05F 3/00

[52] U.S. Cl. ..... 323/343; 323/345; 323/361; 336/144; 336/147

[58] Field of Search ..... 323/247, 255, 258, 262, 323/264, 328, 340, 343, 345, 347, 361; 336/142, 144, 143, 145, 147, 150

[56] References Cited

U.S. PATENT DOCUMENTS

| | | | |
|---|---|---|---|
| 3,195,038 | 7/1965 | Fry | 323/343 |
| 3,711,747 | 1/1973 | Sahara et al. | 323/255 |
| 3,825,925 | 7/1974 | Drusch | 336/143 |
| 3,995,137 | 11/1976 | Okada et al. | 323/262 |
| 4,011,499 | 3/1977 | Betsill et al. | 336/150 |

FOREIGN PATENT DOCUMENTS

| | | | |
|---|---|---|---|
| 603526 | 4/1960 | Italy | 323/345 |

OTHER PUBLICATIONS

Weichert, "Adjustable Magnetic-Coupled Transformer", IBM Tech. Discl. Bul., vol. 11, No. 4, p. 409, Sep. 1968.

*Primary Examiner*—William H. Beha, Jr.
*Attorney, Agent, or Firm*—Wenderoth, Lind & Ponack

[57] ABSTRACT

An electric transformer for supplying an adjustable electric magnitude, especially for regulating purposes, includes several modules having therebetween a binary progression relationship with respect to their power handling capabilities. Each module has a switching network for selectively rendering it operative or inoperative and, each module has at least one primary circuit input coil, the primary coils of each of the modules cooperating with one single secondary output circuit which is common to all of the modules. The switching network of each module being so connected as to allow the neutralization of the effect of the electronic induction of its respective primary coil or coils on the common secondary circuit, while maintaining the magnetic activity of the primary circuits.

7 Claims, 11 Drawing Figures

ELECTRIC TRANSFORMER WITH SELECTIVELY ENERGIZED MODULAR CIRCUITS

This application is a continuation of now abandoned application Ser. No. 497,013, filed May 23, 1983.

TECHNICAL FIELD

The present invention relates to a transformer with variable voltage.

It is known that this type of transformer is used to solve the problem of changing an output voltage from a nominal constant input voltage.

Such transformers have numerous applications:

In galvanoplastics they allow the adjustment of current as a function of the treated product and the concerned surface;

In mechanical tranmissions they are used in speed variators;

In metallurgy they provide the power supplying of adjustable induction furnaces.

Up to now the known transformers have numerous drawbacks.

For example, in top transformers the secondary coil comprises several output terminals, and a switch is applied selectively to one or the other of these terminals to give a variable operating voltage as a function of the height of the secondary coil where the top is.

With such a device one is confronted with serious surges and charge interruptions which causes the installation to quickly wear out.

Also known are "auto-transformers" with a sliding contact which provide a single output terminal on the secondary coil, but said terminal is movable and formed of a carbon roller.

It can be easily seen that upon passing of the piece from one turn to the other, it short-circuits them, causing a heating of the carbon which quickly wears it out.

However, there is an advantage here which stems from a quasi-continuous adjustment, since the pitch is that of a single turn, in such a way that in the case of a coil with 220 winding turns, the pitch is 1/220.

Magnetic amplifiers or "tranducers" comprise a magnetic circuit and a self-induction coil which allows to obtain an adjustment without a moving mechanical apart, since the adjustment is carried out through saturating and desaturating the magnetic circuit by inducing a dephasing.

The result thereof is a non-sinusoidal operation condition and, as a consequence, a displacement between the current and the voltage which leads to a very bad cosine $\phi$.

Finally, the advances in electronics have allowed the utilization of thyristors, giving a non-sinusoidal output signal which is therefore similar to that of a transducer, but without dephasing.

On the other hand, each interruption causes current surges which are unacceptable in operation.

In summary, the known devices have the following drawbacks:

switching with interruption of charge, deformed sinusoidal operation condition, variable cosine $\phi$, power per unit of mass identical to that of a normal transformer, adverse economical consequences due to high cost.

The present invention overcomes all the above drawbacks as will be shown below, since a transformer according to the invention operates in a purely sinusoidal way, has a constant cosine $\phi$, does not cause an interruption in charging and allows any desired fine-adjusting due to the fact that the adjustment step can be practically imperceptible.

BRIEF DESCRIPTION OF THE DRAWINGS

A better understanding of the invention will be given by the following detailed description in which reference is made to the accompanying drawings. Neither the description nor the drawings are limitative. Both are give only as examples.

DETAILED DESCRIPTION OF THE INVENTION

It is an object of the invention to provide an electric transformer for supplying an adjustable electric magnitude, especially for regulating purposes, characterized in that it comprises, on the one hand, at least two modules, each of which having at least one coil with a primary circuit and which are independent, and on the other hand, a single secondary circuit coil, common to all the modules, each of which being associated with means allowing to neutralize its individual electric induction in the common secondary circuit coil, while maintaining the activity of the corresponding magnetic circuit.

According to other features of the invention:

The neutralizing means are formed by an individual connector for each module and has two positions, in one of which a primary circuit coil is normally energized by an original voltage which is nominally constant, and in the other one of which said magnetic circuit remains activated from the same original voltage by inducing a zero voltage by subtraction.

The two positions pf the connector correspond, respectively, to the normal energization of the primary circuit coil and to its short-circuiting.

Between the energizing voltage and each of the two terminals of the the primary circuit coil of each module, two electronic interruptors are inserted, such as thyristors or transistors, mounted top to bottom and controlled selectively to provide the reversal and the energizing of said coil.

Each module comprises two primary circuit coils, energized selectively, either to provide normal induction in the secondary circuit coil, or to neutralize it.

The two coils are of opposite directions with a connector being provided to establish contact between the supplied voltage and one or the other of said two coils.

The two coils are of the same direction and an inverter is inserted between the terminals of one of said coils and the supplied voltage which energizes at the same time the other coil.

The primary circuit coil of the first module is energized by the two main lines of a voltage source, and the corresponding coil of the modules which follow is energized at one of its ends by one of the two main lines and at its other end by an intermediate shunt from a point, for example midpoint of the primary circuit coil of the preceding module.

The modules hve a nominal voltage which provides with a given current a power which is different for each module, the total of these individual powers being substantially equal to the admissible maximum power for the single secondary circuit.

The powers of the modules are regularly decreasing fractions of the total power and whose denominators are integer powers of two.

Figure 1:
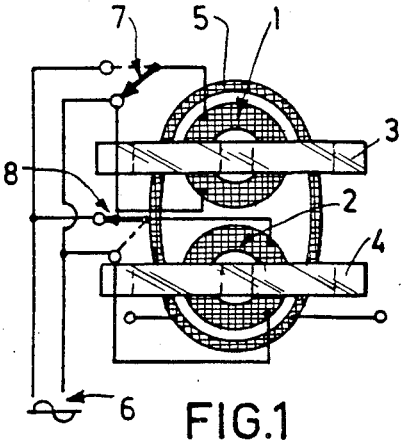
FIGS. 1 and 2 are schematic views, showing, respectively, a plan and a frontal view of the basic transformer according to the invention.
Figure 2:
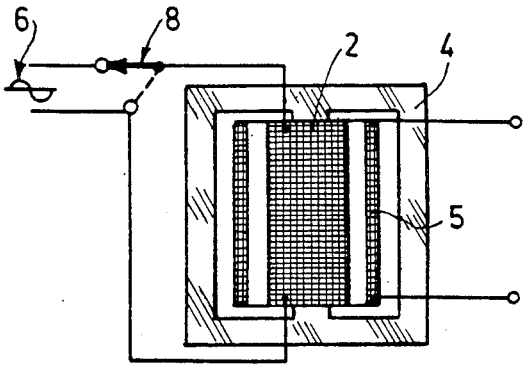

Referring now to FIGS. 1 and 2, it can be seen that a transformer according to the invention may comprise, as here, two modules, each having a single primary coil, 1 and 2, respectively, each being associated with a magnetic circuit, 3 and 4, respectively, said two primary circuits being associated with a single secondary circuit coil 5 which is common to the two modules 1 and 2.

Each primary coil 1 and 2 is independently connected to a voltage source 6, nominally constant, e.g. 220 V.

For each coil, a switch, 7 and 8, respectively, can be set in two positions, in one of which it establishes the normal circuit (connector 8 in FIGS. 1 and 2); whereas in the other position (connector 7 in FIG. 1) the corresponding coil is short-circuited.

According to whether the switch of each coil of the primary circuit is in one or the other of its two positions, the single secondary circuit 5 has a voltage which corresponds either to that resulting only from the coil 1, or to that resulting only from the coil 2, or to that resulting from the action of both coils 1 and 2 at once.

A complete system comprising a transformer according to the invention, is provided with a control device which may be programmed and which acts on all the connectors to cause selectively the individual energization of each primary module.

As a result, upon suitably calibrating the primary modules, it is possible to reach a very high degree of precision and fine adjustment.

There is, of course, a simple embodiment in which a plurality of modules are provided which are equal to each other.

However, in a more elaborate embodiment it is advisable to provide that the modules have a nominal voltage which is estalished for generating, with a given current, a power which is different for each module.

The total of these individual powers is substantially equal to the maximum power which is admissible for the single secondary circuit.

According to a modification of the invention which has proved to be particularly interesting, the modules are sized to provide regularly decreasing fractions of the total power and are established according to a binary code.

In other words, the denominator of each fraction is an integer power of 2, in such a way that the most powerful module provides a power which is equal to half of the total power P, i.e. P/2, with the other modules having a power equal to P/4, P/8, P/16, P/32, P/64 etc., respectively.

It can thus be seen that the adjustment step or minimum jump is equal to the smallest fraction of P provided in the transformer.

It is therefore possible in practice to set up, without difficulty, a transformer formed of a plurality of modules with decreasing dimensions, which, when at the number of 8, provide a degree of fine adjustment of 1/255 for the last module, which is an excellent result $$\left(\frac{1}{255} = \frac{P}{N-1}\right).$$

When the desired power is equal to P/2, only module No. 1 is activated. If it is desired to increase it by P/255, module No. 8 is activated in addition. For a further increase by P/255, module No. 7 is activated, while neutralizing at the same time module No. 8, etc.

With each module being controlled selectively, all combinations are possible, with an adjustment accuracy equal to P/N−1, N−1 being the fraction of the power of the last module of a given unit.

It is to be emphasized, since it is an important feature of the invention, that each primary module has a small volume and that the change from an adjustment of 1/127 to an adjustment of 1/255 requires only the addition of an additional transformer of very small size.

Figure 3:
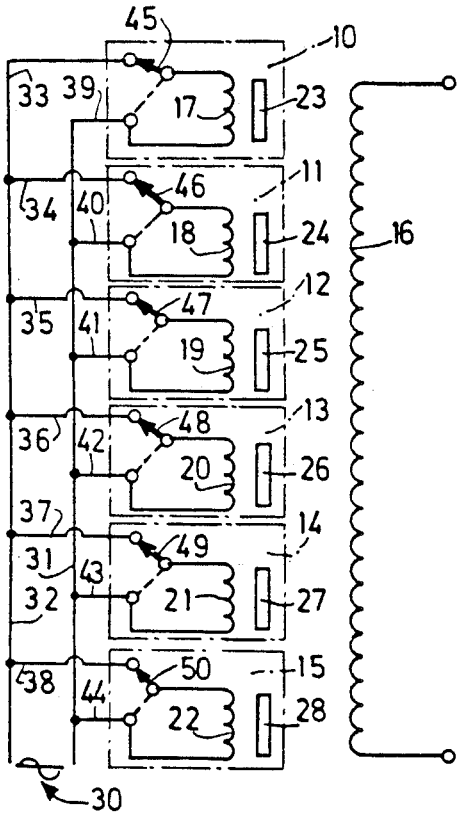
FIGS. 3 to 6 are schematic views, showing different solutions of selective, individual energizing of the different primary modules which a transformer according to the invention comprises.

Turning now to FIG. 3, the electric diagram of a transformer according to the invention is shown which comprises six identical modules 10 to 15 and, as before, only one secondary circuit coil 16.

Each module has a coil 17 to 22 associated with an individual magnetic circuit 23 to 28.

The AC voltage source 30 is connected to two main lines 31 and 32, from which the individual supply lines of each primary module, respectively 33 to 38 and 39 to 44, branch off.

The type of connection chosen is the one already described in connection with FIGS. 1 and 2, i.e. in that each module 10 to 15 is associated with a connector 45 to 50, respectively which is movable between two positions corresponding to normal energizing or to short-circuiting each coil 17 to 22.

In order to simplify the drawing, all modules 10 to 15 are shown as if they all had the same dimensions.

However, in practice, if the preferred embodiment is adopted in which the modules provide different powers, it is clear that they have dimensions which are the smaller as the developed power itself is weak.

If the binary variation of said power with respect to the total power P, admissible by the single coil of the secondary circuit 16, is retained, one obtains for the module 10 a force equal to P/2, for the module 11 a force equal to P/4, etc.

Assuming that the system is energized by 220 V with an effective current of 48 A, results are obtained which are shown in the following table:

| Module | Voltage of primary (V) | Effective current (A) | Power in KVA in mono-phase | Power in KVA in tri-phase | Fraction of the total power | Thickness of magnetic circuit in mm |
|---|---|---|---|---|---|---|
| 10 | 110 | 48 | 5.28 | 15.84 | ½ | 50 |
| 11 | 55 | 48 | 2.64 | 7.92 | ¼ | 25 |
| 12 | 27.5 | 48 | 1.32 | 3.96 | ⅛ | 12.5 |
| 13 | 13.75 | 48 | 0.66 | 1.98 | 1/16 | 6.25 |
| 14 | 6.87 | 48 | 0.33 | 0.99 | 1/32 | 3.125 |

-continued

| Module | Voltage of primary (V) | Effective current (A) | Power in KVA in mono-phase | Power in KVA in tri-phase | Fraction of the total power | Thickness of magnetic circuit in mm |
|---|---|---|---|---|---|---|
| 15 | 3.44 | 48 | 0.165 | 0.5 | 1/64 | 1.56 |
| x | 3.44 | 48 | 0.165 | 0.5 | 1/64 | 1.56 |
| Totals: 220/10.56 ≠ 31.68 1/ | | | | | | |

It results from the above description that the voltage of a secondary is the function of the number of modules under voltage and that therefore it can vary between 0 and 100% by modifying the ratio between the number of the turns of the primary coils and the number of windings of the secondary coil and by taking the precaution to shunt the coils of the non activated modules in order to give them zero impedance, which is evidently the case because the secondary then becomes conductive.

The improved transformer according to the invention operates substantially like a set of transformers whose secondaries are all in series.

This solution leads to considerable savings in mass since the power of such a varying transformer is the same as that of a prior art transformer which is not adjustable.

Figure 4:
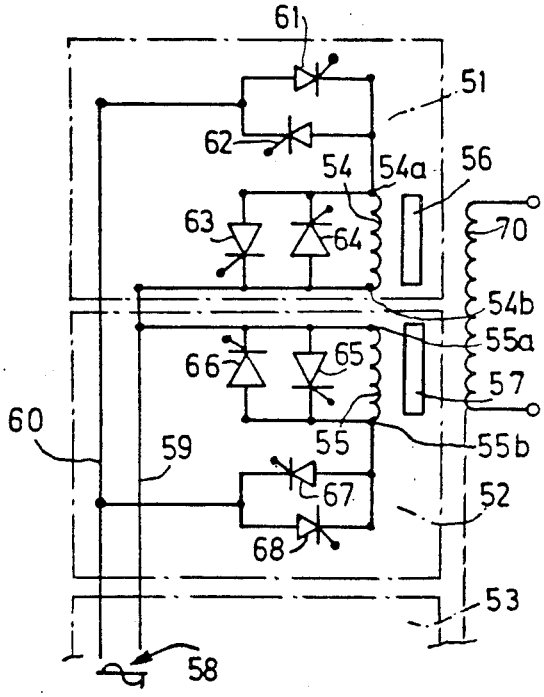

In FIG. 4 a transformer of the same type as before is described, i.e. one where each module comprises only a single primary coil, but with thyristors arranged top to bottom to act selectively upon the induction produced by the primary coil.

In this figure only two modules are shown, 51 and 52 respectively, but the sketch of the module 53 shows that it is possible in accordance with explanations given above, to provide any number of modules above two.

Each module comprises primary circuit coil, 54 and 55 respectively, and an individual magnetic circuit 56 and 57.

Each module is energized from a voltage source 58, connected by two main lines 59 and 60, to each of which the terminals of the two coils 54 and 55 are connected.

Each of the terminals 54*a* and 54*b*, on the one hand, and 55*a* and 55*b*, on the other hand, is connected to a shunt with two branches, on each of which there is a thyristor, said thyristors being connected in parallel and with opposite polarities for the same shunts: 61 and 62–63 and 64–65 and 66–57 and 68.

These thyristors are controlled by known electronic means in such a way that in the same given primary coil a current is supplied, either in one direction or in the other.

It results therefrom that in one case on the single secondary coil 70 appears a voltage which, in a given case, is added to other voltages coming from other modules, whereas in the other case no voltage is induced in the secondary coil.

Thus it can be seen that according to the direction in which the coil is flowed through, there is a neutralization of the effect of induction.

But here again, the magnetization of the magnetic circuits is permanent, regardless of the effective direction of the current. In other words, the magnetic circuits are always energized, but the voltage in the secondary coil is either effectively induced or is zero.

The electronic solution which has been described offers numerous advantages. Among these advantages there is the fact that the putting on and off are performed at the zero of the sine curve in such a manner that regardless of the combination used for the modules, the pure sinosoidal operation condition is kept.

Moreover, the use of thyristors or transistors to effect the selective switching of the modules, allows the reaching of very considerable switching speeds which are necessary to adjust the electric values in heavy-duty performance.

Figure 5:
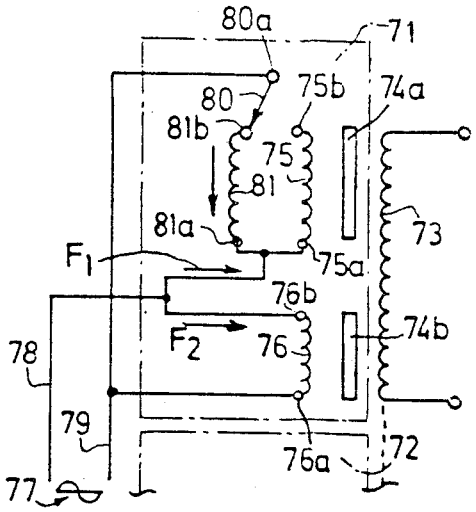
Figure 6:
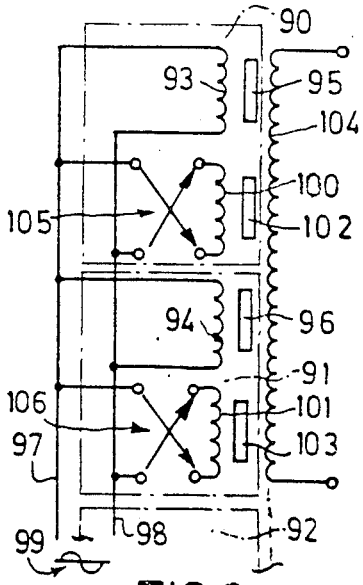

FIGS. 5 and 6 show another embodiment of the invention according to which each module comprises two primary circuit coils.

In FIG. 5 a complete module 71 is shown as well as the indication of a second one 72 with, as before, a single secondary circuit coil 73.

Each module comprises a magnetic circuit 74 and two coils 75 and 76, respectively, of the same pitch.

A voltage source 77 is connected with two lines 78 and 79, the latter being directly connected to one of the terminals 76*a* of the coil 76 and to the terminal 80*a* of the connector 80.

The line 78 is connected to a shunt with two branches, one of which is connected to the terminal 76*b* of the coil 76, and the other one is connected on the one hand to the terminal 75*a* of the coil 75 and on the other hand to the terminal 81*a* of the coil 81 whose pitch is reverse to that of the coil 75 and whose second terminal 81*b* can be connected to the line 79, as the terminal 75*b*, according to the position of the connector 80.

It can be seen that with this arrangement the current which is divided according to the arrows F1 and F2, flows always through the coil 76 and, according to the position of the connector 80, flows through either the coil 75 or the coil 81.

In the first case, a voltage is induced in the secondary coil 73 and this voltage is added to the induced voltage of the coil 76, whereas in the other case the coil 81, having a winding of reversed pitch to that of the coil 75, the induced voltage in the secondary coil 73 will no longer be added to but subtracted from the induced voltage from the primary coil 76, in such a way that, in the end, the secondary coil 73 is flowed through either by the nominal voltage of module 71 or by a zero voltage for the same module 71.

On this assumption, the secondary coil 73 is flowed through, in a given case, only by the currents induced by the other modules.

Turning now to FIG. 6, an arrangement is shown which also comprises two primary coils for each module, but here the neutralizing of each module is obtained by other means.

In this figure, two complete modules 90 and 91 are shown as well as the sketch of a third one 92.

Each of these two complete modules comprises a primary coil 93 and 94, associated with a magnetic circuit 95 and 96, whose terminals are permanently connected to the two lines 97 and 98 which are supplied by a source 99.

Moreover, each of these modules comprises a second coil, 100 and 101 respectively, associated with a magnetic circuit 102 and 103, while all the modules are associated as always, with a single secondary coil 104.

Between the lines 97 and 98, on one hand, and the terminals of the coils 100 and 101, on the other hand, inverters 105 and 106, respectively, are inserted.

It is obvious that with such an arrangement, according to the position which is given to each inverter in each module, the corresponding coil 100, 101 etc. is flowed through in the same manner as the corresponding coil 93, 94 etc. or is in opposition, such as in the case of FIG. 5, the secondary coil 104 is subject to an induced voltage which is added to or deducted from the permanent voltage of the coils 93, 94, etc.

The voltage at the terminals of the secondary coil 104 is thus the result of an addition of voltages of each activated module.

Figure 7:
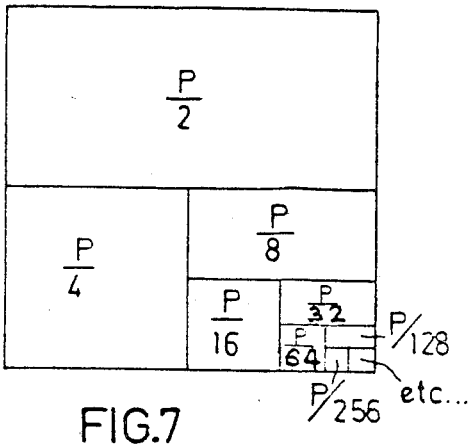
FIG. 7 is a schematic view illustrating a possible design of a transformer according to the invention.

FIG. 7 shows in graphic illustration the manner of dividing the total power P, admissible by the secondary coil into modules, each having, for a given current, a power which is a regularly decreasing fraction of the power P.

This graphical illustration makes it clear how one can, without difficulty, reach an extremely fine adjustment, since it is possible to provide, at any given P, a last module of a power equal to P/128 or even P/256 or P/512 etc.

This graphical presentation also shows how the fine adjustment is obtained by means of an extremely compact and economical module, which is important upon considering that normally the improvement of a given performance is much more complicated and costly than the performance itself.

Figure 8:
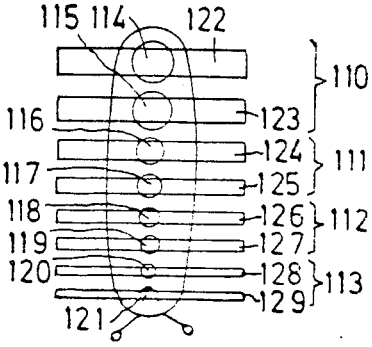
FIG. 8 is a schematic view of a special embodiment of the invention.

FIG. 8 schematically shows a transformer according to the invention which comprises four modules of the type where each of them has two primary coils and two magnetic circuits.

It is shown how for each module 110, 111, 112 and 113 the two coils 114 and 115, 116 and 117, 118 and 119, 120 and 121, respectively, are equal as well as the corresponding magnetic circuits 122 and 123, 124 and 125, 126 and 127, 128 and 129.

It is really fundamental that the two primary circuits and the two magnetic circuits of each module are exactly equal so that each one can neutralize the other.

It should be understood that the resulting voltage is either zero or equal to the sum of the voltage of the two primary circuits of each module.

Each module has a binary function, 0 and 1, obtained by the reversal of the field of a primary relative to the other one.

Figure 9:
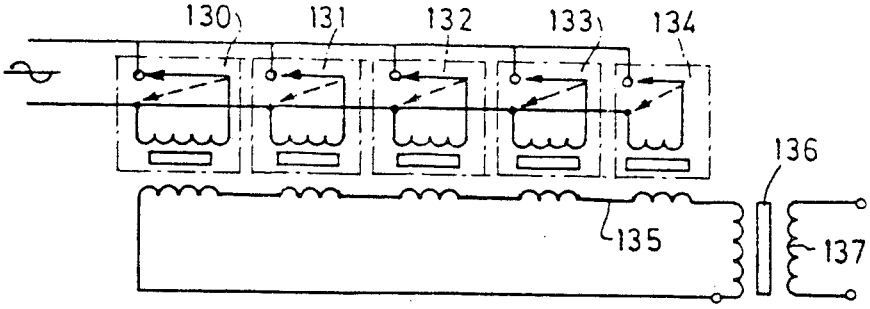
FIG. 9 is a schematic view of the application of the invention to a power transformer.

FIG. 9 shows an example of the invention applied to the adjustment of a transformer.

In this schematic view, five modules 130 to 134 are shown which are associated with a secondary circuit 135 which itself constitutes the primary circuit of a power transformer, comprising, in a known manner, a magnetic circuit 136 and a secondary circuit 137.

Figure 10:
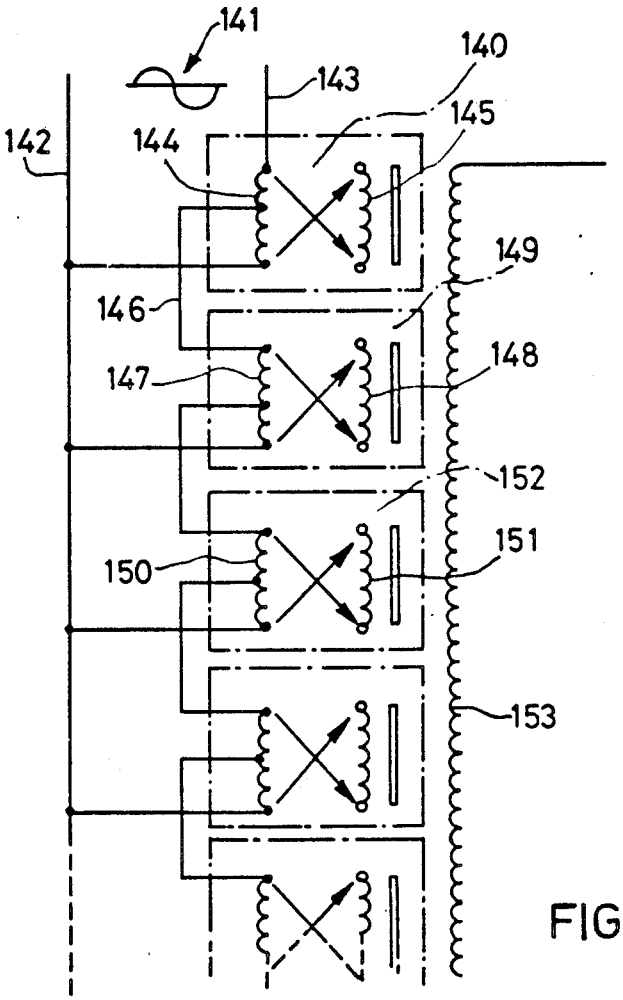
FIG. 10 is a partial schematic view of a modification of the invention.

FIG. 10 is a schematic view of a modification in which a shunt is connected in the middle of one of the two windings of each module and which constitutes the energizing means of the winding according to the module that follows.

Thus, for example, the module 140 is supplied with 220 V from the source 141 through two main lines 142 and 143. This voltage is applied to the winding 144 associated with a corresponding winding 145 matching it in structure.

From the midpoint of the winding 144, a shunt 146 leads to the end of the corresponding winding 147, associated with a winding 148 matching it in structure of the module 149 which follows. The other end of the winding 147 is connected directly to the line 142, in such a way that the supply voltage of the winding 147 is only 110 V.

In the same manner, the winding 150 which is associated with the winding 151 of the module 152 is supplied with a voltage of 55 V and so on, the secondary 153 being always a single one, common to all the modules.

The first module 140 has a power of P/2 with a current of i/4 for a nominal current of i. the corresponding values of the module 149 are P/4 and i/8. the corresponding values of the module 152 are P/8 and i/16 etc.

In this embodiment the number of turns of the primary windings is constant for all the modules, irrespective of their power. In this way a standardization is attained which leads to lower manufacturing costs.

On the other hand, savings are made with respect to raw materials (copper), since the current in each module has a decreasing value for which the diameter of the wire of the coil can be exactly adapted. For a group of modules an excellent adequation is attained between the current and the required, as well as sufficient, quantity of copper.

The practical details of the construction of a transformer according to the invention are within the knowledge of a person skilled in the art. However some dispositions are enumerated below:

Rather than having rational dimensions but which are unpractical as those sketched in FIG. 7, it is certainly preferable to provide for the magnetic circuits dimensions which are constant as to length and size, whereas only the thickness is varied for each module according to the desired power.

This form of structure is sketched in FIG. 8. A numerical example is found in the table of page 11 where the last column indicates the thickness of the magnetic circuit in mm as the only variable dimension from one module to another one, the length and the size being established once for all.

Rather than constructing a large transformer composed exclusively of modules according to the invention, it is possible to associate a simple transformer with a transformer according to the invention and comprising a plurality of modules of small power, said transformer acting as adjustment means for the former.

An application of this principle is found in line transformers to which several modules can be attached which automatically adjust the variations in voltage.

The possibility of combining a large constant voltage transformer and a transformer according to the invention with adjustable voltage, leads to four possible solutions which ae as follows:

The setting up of a complete transformer according to the invention as one single structure;

The setting up of a first structure of a constant voltage transformer and a modular portion according to the invention and then of a second structure, with a group of modules serving only for the fine adjustment of the minimum power;

The setting up of two different structures of a transformer of constant voltage and of a modular transformer according to the invention, with the two structures being electrically connected;

The setting up of an adjustment unit comprising, on the one hand, a transformer of constant voltage at the secondary, and, on the other hand, an adjustable voltage transformer at the primary in the range of −15 to +15%.

As indicated above, the different modules can either be controlled by electro-mechanical means or by electronic means.

Figure 11:
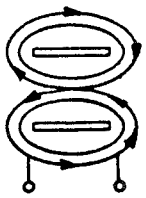
FIG. 11 shows schematically the possibility of an eight shaped coil arrangement for the secondary coil, common to two primary circuits.

When the primary circuit of the modules comprises two coils and two magnetic circuits, the windings can be made either independently for each of them or continuously for the two coils by giving each turn an "8" shaped path, as is schematically shown in FIG. 11.

With the sinusoidal operation condition remaining pure in all cases, a transformer according to the invention allows supplying a rectifier while keeping its natural residual undulation.

It must be noted that the arrangement of two magnetic circuits with two primary circuits for each module gives results which ae totally different from the arrangement known as "magnetic shunt", because this one does not have a primary winding. It leads to leaks which create a considerable current-voltage dephasing and thus a poor cosine $\phi$.

On the contrary, according to the invention, a cosine $\phi$ near 1 is attained with especially those arrangements which are shown in FIGS. 1 and 8.

It is possible to provide a modular transformer according to the invention which uses mixed electromechanical and electronic solutions, particularly by using thyristors for the last module only. These thyristors act only on a very small fraction of the sine curve and cause a variation of power in completely insignificant proportions only, with a very small distortion rate.

The above description makes it obvious that the invention allows to realize an adjustable voltage transformer which has highly remarkable advantages when compared with known devices:

At any moment the load applied to the secondary remains under voltage and this even during times of interruption caused by switching.

The cutting and closing of circuits for putting the modules in action occurs at 0 of the sine curve, since the modification of the number of modules employed has an effect on the amplitude of the sine curve.

The leakage surface is reduced to a minimum and is identical to that of a normal high-performance transformer, especially with the embodiments shown in FIGS. 1 and 8.

Switching occurs without interruption of the charge.

Adjustment occurs along a very fine step-by-step progression.

Stabilization devices of all known types can be used.

The power is unlimited.

A transformer according to the invention is as efficient as a conventional transformer.

Adjustment occurs without interruption of the supply of electricity.

Variation of voltage is performed from a step-by-step control system which avoids putting the voltage of the secondary to zero when it must be modulated.

The invention is not limited to the described and illustrated embodiments, but comprises also all modifications thereof.

I claim:

1. An electric transformer for supplying an adjustable electric output magnitude, including several modules having therebetween a binary progression relationship with respect to their power handling capability and being associated with respective switching means for selectively rendering them operative or inoperative, each module having at least one primary circuit input coil, said primary circuit input coils being connected through said switching means in parallel to a common AC voltage supply source, the primary coils of each of said modules cooperating with one single secondary circuit output coil which is common to all of said modules, through respective seperate magnetic circuits, said switching means being so connected as to neutralize the effect of the electric induction of the respective primary coils on said common secondary output coil, while maintaining the magnetic activity of said magnetic circuits.

2. A transformer according to claim 1, wherein said switching means are formed by a connector individual to each module and having two positions, in one of which said at least one primary circuit coil is normally energized by an original voltage which is nominally constant.

3. A transformer according to claim 2, wherein the two positions of the connector correspond, respectively, to the normal energizing of said at least one primary circuit coil and to its short-circuiting.

4. A transformer according to claim 1, wherein between the energizing voltage and each of the two terminals of said at least one primary circuit coil of each module, two electronic switches are inserted, such as thyristors connected in parallel and with opposite polarities and controlled selectively to allow the energizing of said at least one coil with an alternating voltage.

5. A transformer according to claim 1, wherein the modules have characteristics which provide, for a given value of the current, a power handling capability which is different for each module, the total of these individual power handling capabilities being substantially equal to the admissible maximum power handling capability for the secondary output coil.

6. A transformer according to claim 5, wherein each module includes a magnetic circuit one for each primary coil of said module, said magnetic circuits having constant lengths and widths and their thickness from one module to the other following a binary progression.

7. An electric transformer for supplying an adjustable electric output magnitude including several modules having therebetween a binary progression relationship with respect to their power handling capability and being associated with respective switching means for selectively rendering them operative or inoperative, each modules having at least one primary circuit input coil, the primary coils of each of said modules cooperating with one single secondary circuit output coil which is common to all of said modules, through respective separate magnetic circuits, said switching means being so connected as to neutralize the effect of the electric induction of the respective primary coils on said common secondary output coil, while maintaining the magnetic activity of said magnetic circuits, wherein the modules have characteristics which provide for a given value of the current, a power handling capability which is different for each module, the total of these individual power handling capabilities being substantially equal to the admissible maximum power handling capability for the single secondary output coil and wherein each module includes a magnetic circuit, one for each primary coil of said module, said magnetic circuits having constant lengths and widths and their thickness from one module to the other following a binary progression.

* * * * *